US007024750B2

(12) United States Patent
Isokytöet al.

(10) Patent No.: US 7,024,750 B2
(45) Date of Patent: Apr. 11, 2006

(54) METHOD FOR THE MANUFACTURE OF LAYERED METAL PRODUCT SLABS AND LAYERED METAL PRODUCT SLABS

(75) Inventors: Mika Isokytö, Pori (FI); Saara Koski-Laine, Pori (FI); Taisto Koskinen, Pori (FI); Ari Lind, Pori (FI); Kauko Rajamäki, Noormarkku (FI)

(73) Assignee: Outokumpu Oyj, Espoo (FI)

( * ) Notice: Subject to any disclaimer, the term of this patent is extended or adjusted under 35 U.S.C. 154(b) by 15 days.

(21) Appl. No.: 10/451,442

(22) PCT Filed: Dec. 11, 2001

(86) PCT No.: PCT/FI01/01074

§ 371 (c)(1),
(2), (4) Date: Jun. 19, 2003

(87) PCT Pub. No.: WO02/055753

PCT Pub. Date: Jul. 18, 2002

(65) Prior Publication Data

US 2004/0031582 A1 Feb. 19, 2004

(30) Foreign Application Priority Data

Dec. 20, 2000 (FI) ..... 20002796

(51) Int. Cl.
*B21B 1/46* (2006.01)

(52) U.S. Cl. ..... 29/527.7; 29/527.5; 29/458; 266/265; 266/267; 266/268; 164/419; 164/461; 164/488

(58) Field of Classification Search ..... 266/231, 266/265, 267, 268; 164/488, 489, 490, 461, 164/419; 228/101; 29/527.3, 527.7, 458, 29/527.5

See application file for complete search history.

(56) References Cited

U.S. PATENT DOCUMENTS

| | | | | | |
|---|---|---|---|---|---|
| 1,939,628 | A | * | 12/1933 | Liebmann | 164/100 |
| 2,128,942 | A | * | 9/1938 | Hudson | 164/419 |
| 2,995,816 | A | * | 8/1961 | Ma | 29/527.3 |
| 3,050,848 | A | | 8/1962 | Wilkins | 29/528 |
| 3,237,298 | A | * | 3/1966 | Ma | 29/527.3 |
| 3,367,397 | A | | 2/1968 | Hansson | 164/86 |
| 3,561,399 | A | * | 2/1971 | Federman | 118/65 |
| 3,608,183 | A | * | 9/1971 | Lemelson | 29/527.7 |
| 3,621,561 | A | * | 11/1971 | Higbee et al. | 29/527.7 |
| 3,634,890 | A | | 1/1972 | Conradt et al. | 29/199 |
| 3,695,337 | A | * | 10/1972 | Grand | 164/100 |
| 3,753,669 | A | | 8/1973 | Churchill | 29/199 |
| RE28,188 | E | * | 10/1974 | Higbee et al. | 29/527.7 |
| 3,995,679 | A | | 12/1976 | Brinkmann et al. | 164/86 |
| 4,102,033 | A | * | 7/1978 | Emi et al. | 29/527.3 |
| 4,552,788 | A | | 11/1985 | Sato et al. | 427/374.5 |
| 4,719,962 | A | * | 1/1988 | Haour et al. | 164/461 |
| 4,976,306 | A | * | 12/1990 | Pleschiutschnigg et al. | 164/476 |
| 5,077,094 | A | * | 12/1991 | McCall et al. | 427/319 |

(Continued)

FOREIGN PATENT DOCUMENTS

| | | | |
|---|---|---|---|
| DE | 198 14 988 A 1 | | 7/1999 |
| EP | 0 149 064 A1 | | 7/1985 |
| EP | 0 603 564 A2 | | 6/1994 |
| JP | 63-97340 | | 4/1988 |
| JP | 2001205399 A | * | 7/2001 |
| WO | WO 95 /05100 | | 2/1995 |

*Primary Examiner*—Essama Omgba
(74) *Attorney, Agent, or Firm*—Morgan & Finnegan, LLP

(57) ABSTRACT

A method for the production of a layered metal slab by casting, which strip contains a central layer (2) and surface layers (3) on either side of it. The central layer (2) is introduced as a strip through a mould (4), into which is introduced molten metal (5), the mould (4) is cooled, whereupon a layered structure (1) is formed as the metal solidifies.

16 Claims, 3 Drawing Sheets

U.S. PATENT DOCUMENTS 5,480,496 A * 1/1996 Ward ..... 148/437
5,665,437 A * 9/1997 Frommann et al. ..... 427/591
5,669,436 A * 9/1997 Papich et al. ..... 164/461
5,850,869 A * 12/1998 Pleschiutschnigg et al. 164/419
5,855,238 A * 1/1999 Pleschiutschnigg et al. 164/461
6,095,232 A * 8/2000 El Gammal et al. ..... 164/461
6,161,608 A * 12/2000 Pleschiutschnigg ..... 164/461
6,209,620 B1 * 4/2001 Pleschiutschnigg ..... 164/461

* cited by examiner

METHOD FOR THE MANUFACTURE OF LAYERED METAL PRODUCT SLABS AND LAYERED METAL PRODUCT SLABS

The present invention relates to the method according to the preamble of patent claim 1 for the manufacture of layered metal slabs. The invention also relates to the layered metal product slab according to patent claim 10.

The method according to the invention is especially intended for the manufacture of coin blanks. In some types of coin, a multi-layered metal is used, where the central layer is of a different material to the surface layers. The layered material is typically manufactured by placing three material strips in layers on top of each other and by rolling the material strips into a layered structure, using heavy rolling force. After rolling, diffusion annealing has typically still been necessary in order to ensure that the layers remain fast together. After diffusion annealing, the blanks have been rolled once again to their final size. The disadvantages known in the prior art are e.g. the special equipment required. In addition, the manufacturing technology used is demanding concerning impurities, since the impurities caught between layers have caused problems when joining the layers to each other.

The object of this invention is to achieve a method for the manufacture of a layered metal product, by means of which the disadvantages known in the prior art can be prevented.

The characteristics of the invention are presented in the patent claims.

There are a number of significant advantages in the solution according to the invention. It is possible to achieve an extremely high-quality juncture between the surface and central layers by means of the method according to the invention. By using nickel strip as the material for the central layer and cupro-nickel for the surface layers, an extremely beneficial layered structure is achieved which has good bonding properties. The multi-layer casting achieved by using the method is thus extremely well suited for further processing. After further forming and other necessary stages, the structure achieved by using the method is extremely well suited for use as e.g. coin blanks.

Figure 1:
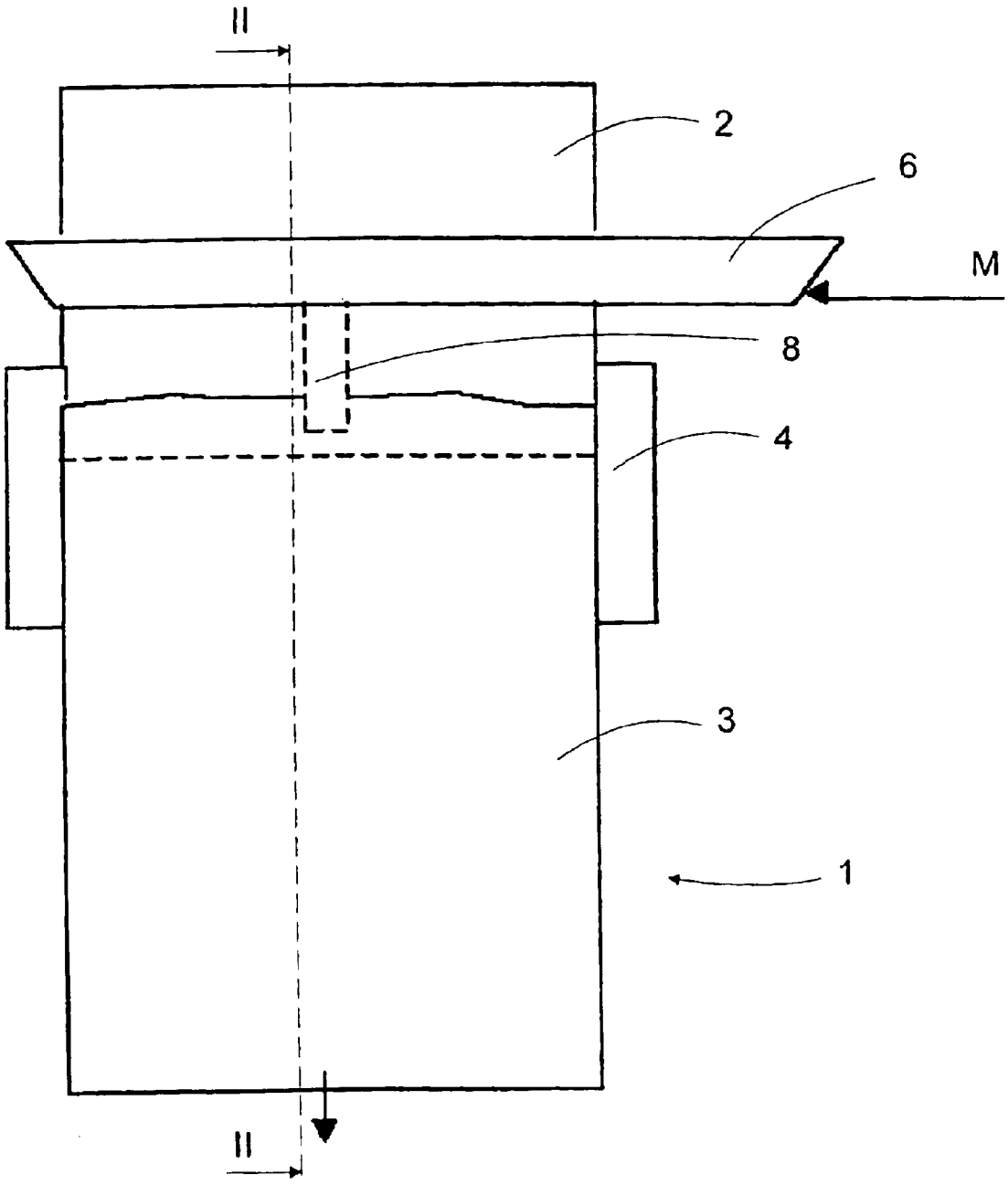
Figure 2:
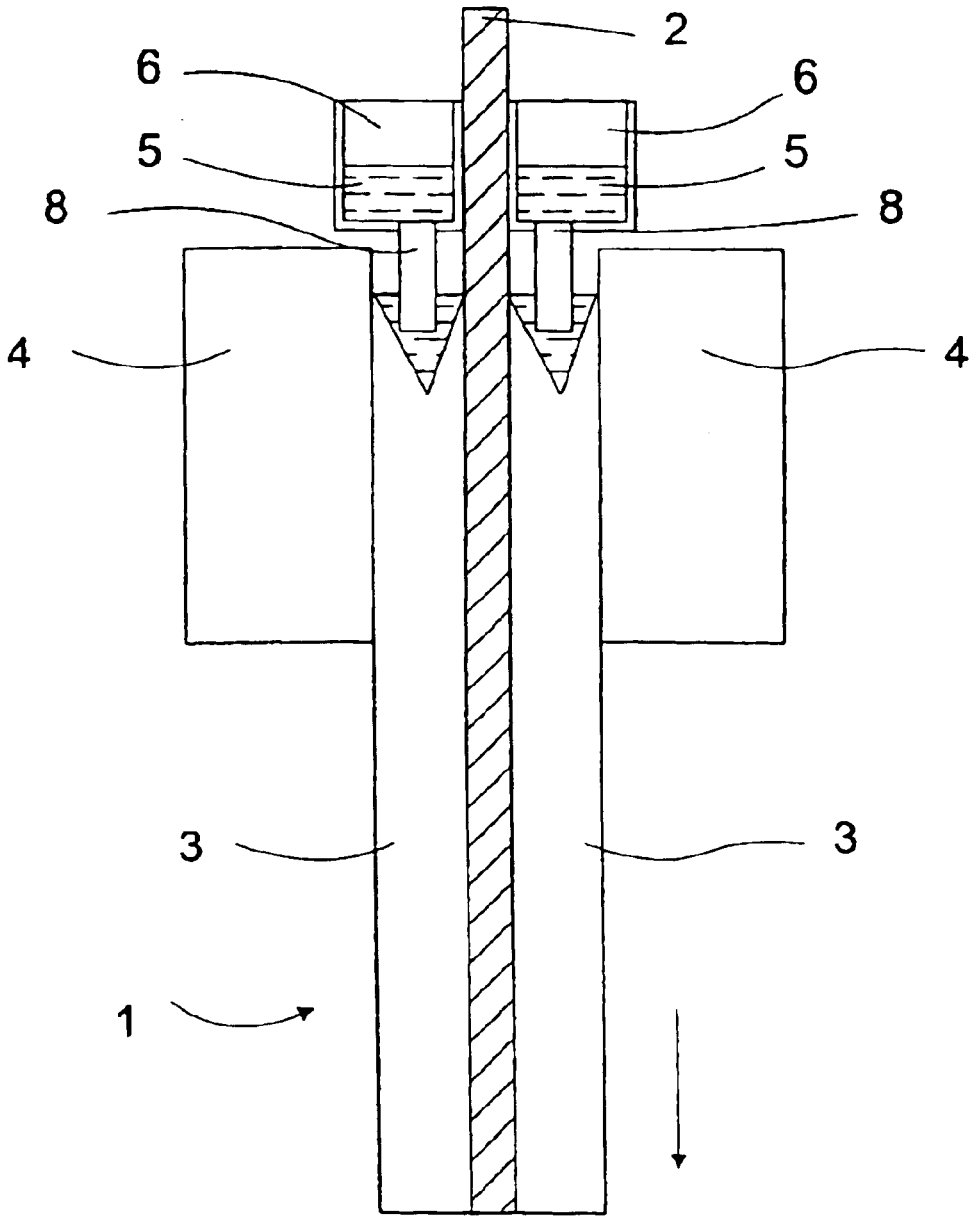
Figure 3:
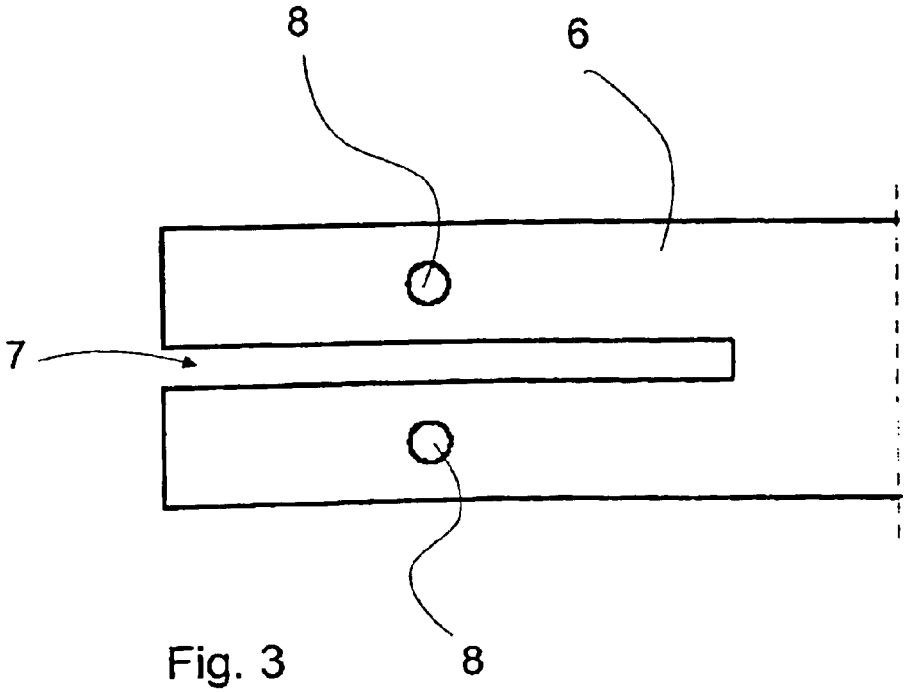
Figure 4:
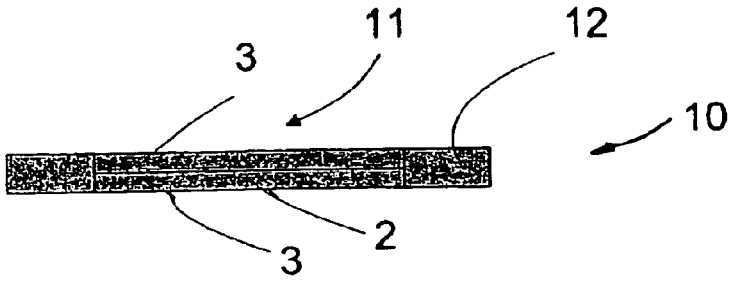

The invention is described more detailed with the aid of a preferable example with reference to the enclosed figures, where FIG. 1 illustrates a simplified version of the casting step according to the invention, FIG. 2 illustrates a simplified section along the line from II—II in FIG. 1 in a zoomed scale, FIG. 3 illustrates a part of the launder section used in the method according to the invention as a top view, and FIG. 4 illustrates the cross section of a coin, where a coin blank produced by the method according to the invention is used.

The invention relates to a method for manufacturing a layered metal slab 1 direct by casting, which strip comprises a central layer 2 and surface layers 3 on either side of it. In the method the central layer 2 is introduced as a strip through a mould 4, into which is introduced molten metal 5, the mould 4 is cooled, whereupon a layered structure 1 is formed as the molten metal 5 solidifies. In the method, a metallurgical bond is formed between the surface layer 3 and the central layer 2. Typically the molten metal 5 is conducted to the mould 4, on both sides of the central layer 2. The melt 5 is ordinarily conducted via a launder element 6 to the mould. The melt is conducted to the launder element from a melting furnace (not illustrated) in the direction of the arrow M. In the method according to the invention a special launder element 6 is used, which includes an opening 7 for conducting the central-layer strip 2 into the mould. The central-layer strip can be introduced into the mould as a continuous strip or as specially cut-off lengths. From the launder element 6 the melt is conducted to the mould at least via one feed element 8. According to the application form of the figure, there are two feed elements 8, one either side of central-layer strip 2. The feed elements 8 are typically pipe elements, of which the end near the mould extends preferably beneath the surface of the melt in the mould.

In connection with the method, non-oxidizing conditions are used in order to protect the melt 5, at least in the area between the mould 4 and the duct part 6. Typically the launder element 6 includes a cover for preventing oxidation of the melt. Typically shielding gas, such as argon or nitrogen, is introduced into the mould above the surface of the melt, to prevent oxidizing of the melt. Additionally, the space between the mould 4 and the launder element 6 is typically sealed.

The melting point of the central layer 2 is higher than the melting point of the metal of the surface layers. According to one of the beneficial application forms of the invention, the surface layer 3 is an alloy of nickel and copper, preferably an alloy, which is about 75 weight percent copper and about 25 weight percent nickel. Thus the central layer 2 contains mostly nickel; the most preferably the central layer is about 99 weight percent nickel. The temperature of the melt conducted from the melting furnace to the launder element 6 is typically in the region 1200–1500° C., preferably 1300–1400° C. The molten metal solidifies in the mould, which is typically water-cooled.

In another typical application the surface layer is nickel brass which contains about 75 weight per cent copper, 20 weight per cent zinc and 5 weight per cent nickel. The central layer is nickel also in this application form.

In a typical application form the thickness of the central layer strip 2 is from about 7–15 mm, typically 8–9 mm, where the thickness of the whole cast slab can be in the region 100–200 mm, preferably 140–160 mm.

The slab 1 cast according to the method is further processed by forming, particularly by rolling. The casting 1 is further processed in such a way as to achieve a metal product blank, in particular a coin blank. Thus the cast slab is firstly hot rolled, its surface is milled, cold rolled, cut into narrow strips, after which the strip is stamped into metal product blanks, in particular coin blanks.

Layered metal product slabs, comprising a central layer and surface layers, are manufactured by the method according to the invention. The multi-layered metal slab according to the invention is especially suitable for coin blanks. Typically, blanks produced by the method according to the invention are used, for example in coins 10, where the center 11 of the coin is a different color to its radial outer annular area 12. One such coin is e.g. the one-euro piece. Thus the method according to the invention is especially suitable as the center 11 of a coin used in the production of layered metal blanks.

The object of the invention is therefore also a layered metal product slab, particularly a coin blank, comprising a central layer and surface layers. The layered structure is formed by casting surface layers 3 onto central layer 2. The cast layer metal strip is used especially as the central part 11 of coin blanks, as for example the one-euro piece. The strip in question comprises two surface layers 3 made of nickel copper, where the copper content is 75% and the nickel content is 25%. Between the surface layers there is a central layer 2, which consists of at least 99.2% nickel, and no more than 0.2% iron. The thickness of the central layer of the final product is typically below 10%, preferably 6.3–7.7%, of the total thickness of the layered structure. One other example is the 2-euro piece, in connection with the production of which the method according to the invention can be utilized.

After casting, the layered metal strip undergoes further processing. The slab is hot rolled, after which the surface of the strip is milled. Then the strip is cold rolled. The rolled strip is cut into narrow strips. The coin blanks are punched from the narrow strips and finished, for example edged, heat treated and polished.

For a professional in the field, it is obvious that the invention can be used to produce other metal product blanks as well as coin blanks.

What is claimed is:

1. A method for the production of a layered metal slab by casting, said slab comprising a central metal layer and surface metal layers on opposite sides of the central layer, the method comprising:

providing a mould in which the layered metal slab is formed, the mould shaped to form the surface layers on the opposite sides of the central layer;

providing a launder element with an opening therein;

introducing the central layer as the strip through the opening in the launder element and through the mould;

conducting molten metal into the mould via the launder element to form molten metal surface layers on the opposite sides of the central layer;

cooling the mould to form the layered metal slab as the molten metal surface layers solidify, the surface layers being metallurgically bonded to the central layer of the slab, the whole thickness of the slab being in the region of 100–200 mm; and working the layered metal slab by rolling.

2. A method according to claim 1, further comprising conducting the molten metal into the mould through at least one feeder element situated within a lower portion of the launder element to form the molten metal surface layers on both sides of the central metal layer.

3. A method according to claim 2, wherein there are two feeder elements, one on either side of the central layer.

4. A method according to claim 2, wherein the at least one feeder element has an end that extends beneath the surface of the melt in the mould.

5. A method according to claim 1, further comprising using non-oxidizing conditions in order to protect the melt at least in the area between the mould and the launder element.

6. A method according to claim 1, wherein the surface layers are an alloy of nickel and copper.

7. A method according to claim 6, wherein the surface layers are an alloy of nickel and copper having a copper content of about 75 wt % and a nickel content of about 25 wt %.

8. A method according to claim 6, wherein the surface layers are nickel brass having a copper content of about 75 wt %, a zinc content of about 20 wt %, and a nickel content of about 5 wt %.

9. A method according to claim 1, wherein the central layer contains essentially nickel.

10. A method according to claim 9, wherein the central layer contains about 99 wt % nickel.

11. A method according to claim 1, further comprising further processing the cast slab in such a way that a metal product blank is obtained.

12. A method according to claim 11, wherein the metal product blank is a coin blank.

13. A method according to claim 1, further comprising hot rolling the cast slab, milling the surface of the cast slab, cold rolling the slab, cutting the slab into narrow strips, and then punching metal product blanks from said strips.

14. A method according to claim 13, wherein the metal blanks are coin blanks.

15. A method according to claim 1, wherein the metal of the central layer has a melting point that is higher than the melting point of the metal of the surface layers.

16. A method according to claim 1, wherein the central metal layer is introduced through the mould as a continuous metal strip or as a preselected length of metal strip.

* * * * *